US009945318B2

(12) United States Patent
Park et al.

(10) Patent No.: US 9,945,318 B2
(45) Date of Patent: Apr. 17, 2018

(54) CYLINDER BLOCK

(71) Applicant: HYUNDAI MOTOR COMPANY, Seoul (KR)

(72) Inventors: Hun Young Park, Ulsan (KR); Young Gi Kim, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 15/197,135

(22) Filed: Jun. 29, 2016

(65) Prior Publication Data

US 2017/0159602 A1 Jun. 8, 2017

(30) Foreign Application Priority Data

Dec. 4, 2015 (KR) ..... 10-2015-0171912

(51) Int. Cl.
*F02F 1/00* (2006.01)
*F02F 1/18* (2006.01)

(52) U.S. Cl.
CPC ..... *F02F 1/18* (2013.01); *F02F 1/004* (2013.01); *F05C 2251/048* (2013.01); *F05C 2253/12* (2013.01)

(58) Field of Classification Search
CPC ..... F02F 1/004; F02F 1/18
See application file for complete search history.

(56) References Cited

FOREIGN PATENT DOCUMENTS

| | | | |
|---|---|---|---|
| JP | 2000-212717 | A | 8/2000 |
| JP | 2007-522341 | A | 8/2007 |
| JP | 2014-231791 | A | 12/2014 |
| JP | 2015-040331 | A | 3/2015 |
| KR | 10-2001-0050668 | A | 6/2001 |
| KR | 10-2004-0021980 | A | 3/2004 |
| KR | 10-2014-0004311 | A | 1/2014 |
| KR | 10-2014-0022228 | A | 2/2014 |
| WO | 2005/112603 | A2 | 12/2005 |

OTHER PUBLICATIONS

Murat Ciniviz, Mustafa Sahir Salman, Eyüb Canli, Hüseyin Köse and Özgür Solmaz, Feb. 24, 2012. Ceramic Coating Applications and Research Fields for Internal Combustion Engines, Ceramic Coatings—Applications in Engineering, Prof. Feng Shi (Ed.), ISBN: 978-953-51-0083-6, InTech, Available from: https://www.researchgate.net/file.PostFileLoader.htm.*

Korean Office Action dated Aug. 26, 2016, issued in Korean Patent Application No. 10-2015-0171912.

* cited by examiner

*Primary Examiner* — Kevin A Lathers
(74) *Attorney, Agent, or Firm* — McDermott Will & Emery LLP

(57) ABSTRACT

A cylinder block made of aluminum includes an inner wall defining an inner space wherein a piston moves, an insulating coating layer partially disposed along an inside surface of the inner wall, and an Fe, or iron, sprayed layer coating an inner surface of the inner wall and the insulating coating layer, the Fe sprayed layer being formed by a thermal spaying process.

4 Claims, 2 Drawing Sheets

PRIOR ART

CYLINDER BLOCK

CROSS-REFERENCE TO RELATED APPLICATION

This application claims the benefit of priority to Korean Patent Application No. 10-2015-0171912, filed on Dec. 4, 2015 with the Korean Intellectual Property Office, the disclosure of which is incorporated herein by reference.

TECHNICAL FIELD

The present disclosure relates to a cylinder block and further relates to achieving knocking reduction by improved cooling performance and an improvement of thermal efficiency by thermal insulation.

BACKGROUND

In an engine, a portion of heat generated from a cylinder, or combustion chamber, is absorbed by a cylinder head, a cylinder block, an intake/exhaust valve, a piston, and so on. When these components are heated to an excessively high temperature, thermal deformation or lubrication deficiency due to a damage of an oil film formed over an inner wall of the cylinder block occurs, thereby generating thermal defects.

Thermal defects of the engine may generate abnormal combustion such as defective combustion and knocking such that the engine suffers damage such as erosion of the piston. On the other hand, excessive cooling of the engine may lead to problems such as degradation of fuel economy caused by low thermal efficiency, cylinder wear at low temperature, and so on. Thus, it is advantageous to properly control the temperature of a coolant C (see FIG. 1) flowing between an outer wall and an inner wall in the cylinder block.

As shown in FIG. 1, in a conventional case, a cylinder liner 10 made of cast iron is provided along an inner wall of a cylinder block in order to enhance thermal efficiency through prevention of heat loss. In this case, however, lightness of an associated vehicle may not be achieved due to weight of the cylinder liner 10. Although an upper portion of the cylinder block is cooled to prevent abnormal combustion such as knocking, the entire inner wall of the cylinder block is surrounded by the cylinder liner 10 made of cast iron such that it is difficult to solve the above-mentioned problems.

The matters disclosed in this section are merely for enhancement of understanding of the general background of the disclosure and should not be taken as an acknowledgment or any form of suggestion that the matters from the related art already known to a person skilled in the art.

SUMMARY

Therefore, the present disclosure has been made in view of the above problems, and it is an object of the present disclosure to provide a cylinder block to achieve knocking reduction by improved cooling performance and improvement of thermal efficiency by thermal insulation.

In accordance with the present disclosure, the above and other objects may be accomplished by the provision of a cylinder block made of aluminum including an inner wall defining an inner space where a piston moves, an insulating coating layer partially disposed along an inside surface of the inner wall, and an Fe, or iron, sprayed layer coating the inner surface of the inner wall and the insulating coating layer, the Fe sprayed layer being formed by a thermal spaying process.

The insulating coating layer may have a thickness $\Delta x_1$ determined by Equation 1 below, $$\Delta x_1 = k_1 * (\Delta T/Q - \Delta x_2/k_2 - \Delta x_d/k_3) \quad \text{[Equation 1]}$$

where $\Delta x_1$ is a thickness of the insulating coating layer, $k_1$ is a thermal conductivity of the insulating coating layer, $\Delta T$ is a temperature difference between the inner space and the inner wall, Q is a heat flow per unit area, $\Delta x_2$ is a thickness of the inner wall, $k_2$ is a thermal conductivity of the inner wall, $\Delta x_3$ is a thickness of the Fe sprayed layer, and $k_3$ is a thermal conductivity of the Fe sprayed layer.

The thermal conductivity $k_1$ of the insulating may be in the range of 0.8 to 5.0 W/mK.

The insulating coating layer may comprise one selected from the group consisting of 3% by weight of Yttria-Stabilized Zirconia (YSZ), 7% by weight of YSZ, and 7% by weight of $Gd_2Zr_2O_7$.

The insulating coating layer may be disposed at a portion of the inner wall corresponding to a moving path of the piston in the inner space.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Reference will now be made in detail to embodiments of the present disclosure, examples of which are illustrated in the accompanying drawings.

Figure 1:
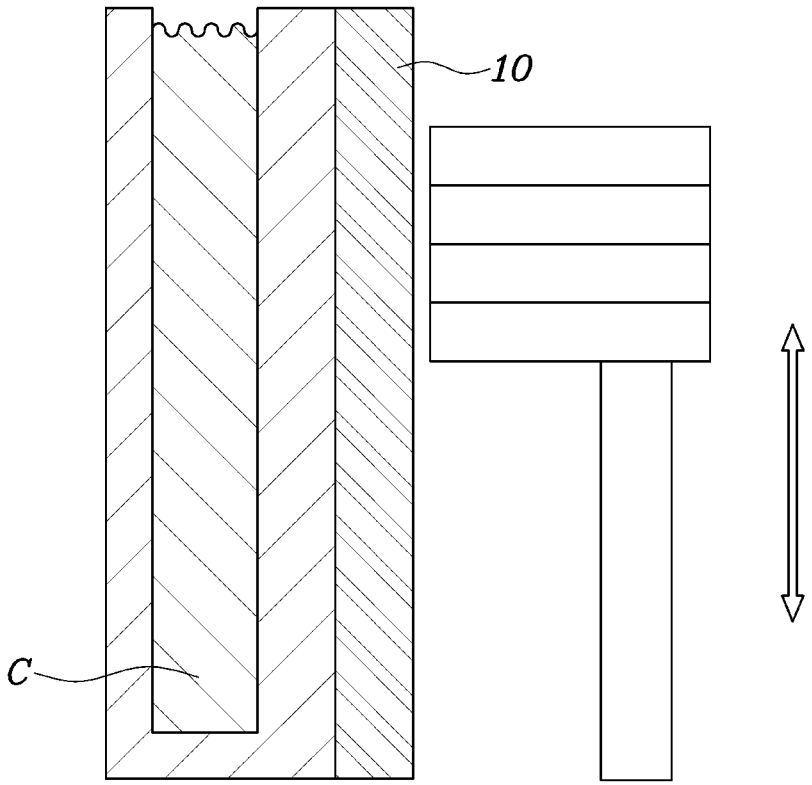
FIG. 1 is a cross-sectional view illustrating a conventional cylinder block.
Figure 2:
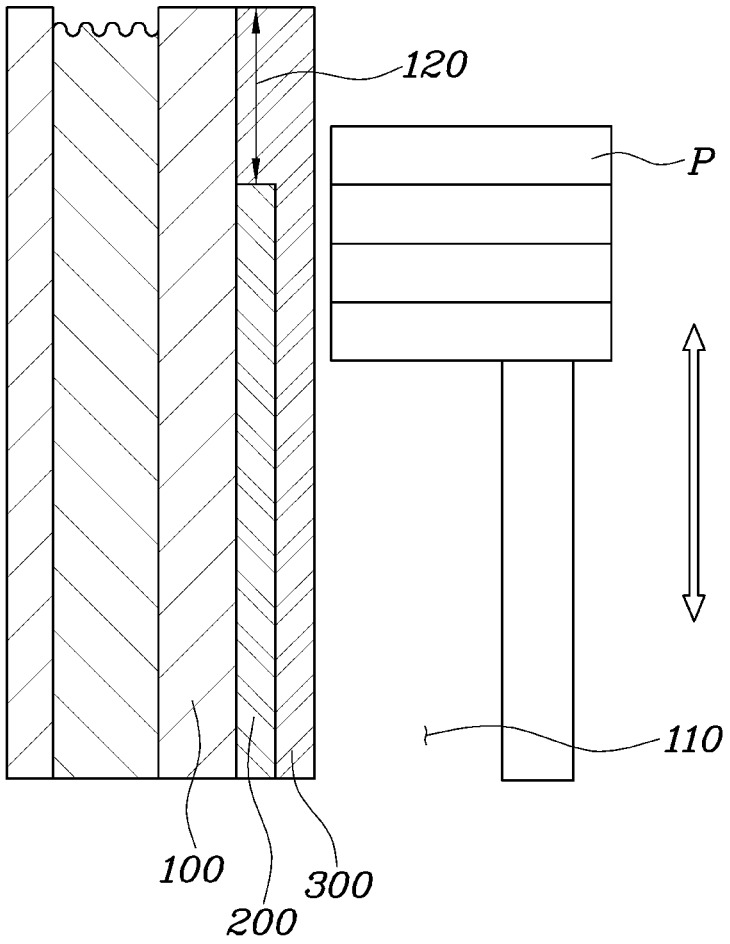
FIG. 2 is a cross-sectional view illustrating a cylinder block according to an embodiment of the present disclosure.

As illustrated in FIG. 2, a cylinder block made of aluminum according to an embodiment of the present disclosure may include an inner wall 100 defining an inner space 110 where a piston P moves, an insulating coating layer 200 partially disposed along an inner surface of the inner wall 100, and an Fe, or iron, sprayed layer 300 formed by a thermal spraying process, which is disposed along the inside surface of the inner wall 100 and the insulating coating layer 200.

A conventional cylinder liner made of cast iron may be provided along the inner wall 100 of the cylinder block in order to enhance thermal efficiency through prevention of heat loss. In this case, however, lightness of an associated vehicle may not be achieved due to a weight of the cylinder liner. Although an upper portion 120 of the cylinder block may be cooled to prevent abnormal combustion such as knocking, the entire inner wall 100 of the cylinder block may be surrounded by the cylinder liner made of cast iron, such that it may be difficult to solve the above-described problems.

In other words, there is a trade-off between knocking reduction due to improved cooling performance and improvement of thermal efficiency by thermal insulation.

To achieve both of the above-described goals, instead of the cylinder liner made of cast iron, the insulating coating layer 200 may be provided on the inner wall 100 of the cylinder block made of aluminum and the Fe sprayed layer 300 may be provided on the insulating coating layer 200 and the inner wall 100. In using the Fe sprayed layer 300, even though there are some advantages of lightness of the associated vehicle and improved cooling performance, heat loss may be generated due to an absence of thermal insulation.

To this end, the insulating coating layer 200 may be provided between the Fe sprayed layer 300 and the cylinder block to prevent heat loss. As described above, to achieve both goals (knocking reduction and improvement of thermal efficiency by thermal insulation), the insulating coating layer 200 may be provided at the inner space 110, except for the upper portion 120 of the inner space 110 which does not require significant thermal insulation.

The thermal spraying process may include melting a powder type material using a high temperature heat source such as a flame or plasma, and spaying the melted material. The Fe sprayed layer 300 may be formed on the inside surface of the inner wall 100 using powder type iron by the thermal spaying process.

Thus, high thermal efficiency may be expected by forming the insulating coating layer 200 at a portion of the inner wall 100 requiring thermal insulation, that is, central and lower portions of the inner wall 100. In addition, knocking reduction may be expected by improved cooling performance of the upper portion 120 because the Fe sprayed layer 300 may be formed only on the upper portion 120 of the inner wall 100. Further, lightness of the associated vehicle may be achieved by an absence of the cast iron cylinder liner.

The insulating coating layer 200 may be disposed at a portion of the inner wall 100 corresponding to, or near or abutting, a moving path of the piston P in the inner space 110 defined by the inner wall 100. In other words, the piston P may move up and down in the inner space 110 of the cylinder block. The insulating coating layer 200 may be disposed on portions of the inner space 110, except for a portion of the inner wall 100 corresponding to at least a region where an upper portion of the piston P is positioned when the piston P moves up to an uppermost position thereof, or an upper changeover point.

Thus, thermal insulation may be maximized in the central and lower portions of the inner space 110 defined by the piston P, and cooling performance may be maximized in the upper portion 120 of the inner space 110, where the insulating coating layer 200 may not be present.

In determining a thickness of the insulating coating layer 200, the thickness may be determined by Equation 1 below.

$$\Delta x_1 = k_1 * (\Delta T/Q - \Delta x_2/k_2 - \Delta x_3/k_3) \quad \text{[Equation 1]}$$

wherein $\Delta x_1$: thickness of the insulating coating layer 200, $k_1$: thermal conductivity of the insulating coating layer 200, $\Delta T$: temperature difference between the inner space 110 and the inner wall 100, Q: heat flow per unit area, $\Delta x_2$: thickness of the inner wall 100, $k_2$: thermal conductivity of the inner wall 100, $\Delta x_3$: thickness of the Fe sprayed layer 300, $k_3$: thermal conductivity of the Fe sprayed layer 300.

Above Equation 1 is derived from Equation 2 and Equation 3.

$$U = \Delta x_t * (Q/\Delta T) \quad \text{[Equation 2]}$$

wherein U: total thermal conductivity of the inner wall 100, the Fe sprayed layer 300 and the insulating coating layer 200, $\Delta x_t$: total thickness of the inner wall 100, the Fe sprayed layer 300 and the insulating coating layer 200.

$$U = 1/(\Delta x_1/(k_1 * \Delta x_t) + \Delta x_2/(k_2 * \Delta x_t) + \Delta x_3/(k_3 * \Delta x_t)) \quad \text{[Equation 3]}$$

Equation 1 is derived by combining Equation 2 and Equation 3 to eliminate U, reducing the combined Equation using $\Delta x_t$ as a common denominator, and arranging the resultant Equation.

Thus, the thickness $\Delta x_1$ of the insulating coating layer 200 may be determined by the temperature difference $\Delta T$ between the inner space 110 and the inner wall 100, and the thermal conductivity $k_1$ of the insulating coating layer 200, which are based on a desired degree of thermal insulation. The heat flow per unit area Q, the thickness $\Delta x_2$ of the inner wall 100, the thermal conductivity $k_2$ of the inner wall 100, the thickness $\Delta x_3$ of the Fe sprayed layer 300 and the thermal conductivity $k_3$ of the Fe sprayed layer 300 are respectively predetermined values as general values.

By determining the thickness $\Delta x_1$ of the insulating coating layer 200 using Equation 1 based on a desired degree of thermal insulation, there are advantages of product cost reduction and a weight-reduced vehicle. The temperature difference $\Delta T$ between the inner space 110 and the inner wall 100 may be determined in the range of 20° C. to 30° C. Generally, when the temperature of the cylinder block made of aluminum in the engine rises above a determined temperature, a durability problem may be generated in the engine due to high temperature. This may be caused by degradation of material properties by aging. When the temperature difference $\Delta T$ between the inner space 110 and the inner wall 100 is more than 30° C., the temperature of the inner space 110 may exceed 240° C., causing a durability problem of the cylinder block.

On the other hand, when the temperature difference $\Delta T$ between the inner space 110 and the inner wall 100 is less than 30° C., heat retention based on thermal insulation may be insufficient. Thus, the temperature difference $\Delta T$ between the inner space 110 and the inner wall 100 may be determined to be in the range of 20° C. to 30° C.

The thermal conductivity $k_1$ of the insulating coating layer 200 may be in the range of 0.8 W/mK to 5.0 W/mK. When the conductivity $k_1$ of the insulating coating layer 200 is less than 0.8 W/mK, costs may be increased in forming the insulating coating layer 200. Further, when the conductivity $k_1$ of the insulating coating layer 200 is greater than 5.0 W/mK, the insulating coating layer 200 may be unsuitable to achieve desired thermal insulation. Thus, the thermal conductivity $k_1$ of the insulating coating layer 200 may be in the range of 0.8 W/mK to 5.0 W/mK.

The thermal conductivity $k_1$ of the insulating coating layer 200 may be in the range of 1.5 W/mK to 3.5 W/mK. Generally, a material used as the insulating coating material may include 3% by weight of Yttria-Stabilized Zirconia (YSZ), 7% by weight of YSZ or $Gd_2Zr_2O_7$, and so on. In the case of 3% by weight of YSZ, thermal conductivity of about 3.2 W/mK may be exhibited, and in the case of 7% by weight of YSZ, thermal conductivity of about 1.5 W/mK may be exhibited.

Further, $Gd_2Zr_2O_7$ has thermal conductivity of about 0.8 W/mK to about 1.5 W/mK. Thermal conductivity may be proportional to heat transfer. Compared to aluminum having thermal conductivity of about 150 W/mK and iron having thermal conductivity of about 44 W/mK, the materials used as the insulating coating material may have a low thermal conductivity. Thus thermal insulation in the insulating coating material may be effectively performed.

Example

The heat flow per unit area Q is assumed to be 24,000 $W/m^2$, the thickness $\Delta x_2$ of the inner wall is set to 0.08 m, the thickness $\Delta x_3$ of the Fe sprayed layer is set to 0.002 m, and the desired temperature difference $\Delta T$ between the inner space and the inner wall is assumed to be 25K. Further, the thermal conductivity $k_1$ of the insulating coating layer selected as 7% by weight of YSZ is 1.5 W/mK, and generally the thermal conductivity $k_2$ of the inner wall made of aluminum is 151 W/mK, and the thermal conductivity $k_3$ of the Fe sprayed layer formed is 44 W/mK. When above parameters are substituted into Equation 1, a thickness $\Delta x_1$ of the insulating coating layer is calculated to be 0.0007 m.

Consequently, the thickness $\Delta x_1$ of the insulating coating layer selected as 7% by weight of YSZ is 0.0007 m in, or of, 0.0827 m, which is a total thickness of the Fe sprayed layer and the insulating coating layer.

As is apparent from the above description, in a cylinder block according to an embodiment of the present disclosure, advantages of knocking reduction by improved cooling performance, and improvements of thermal efficiency by thermal insulation may be expected. Further, due to an absence of a cylinder liner made of cast iron, lightness of the associated vehicle may be achieved thereby improving fuel economy.

Although the embodiments of the present disclosure have been disclosed for illustrative purposes, those skilled in the art will appreciate that various modifications, additions and substitutions are possible, without departing from the scope and spirit of the disclosure as disclosed in the accompanying claims.

What is claimed is:

1. A cylinder block made of aluminum, comprising:

an inner wall defining an inner space wherein a piston moves;

an insulating coating layer partially disposed along an inside surface of the inner wall; and an Fe sprayed layer coating the inside surface of the inner wall and the insulating coating layer, the Fe sprayed layer being formed by a thermal spraying process, wherein the insulating coating layer has a thickness Δx1 determined by the following Equation 1, $$\Delta x = k1*(\Delta T/Q - \Delta x2/k2 - \Delta x3/k3),$$

wherein Δx1 is a thickness of the insulating coating layer, k1 is a thermal conductivity of the insulating coating layer, ΔT is a temperature difference between the inner space and the inner wall, Q is a heat flow per unit area, Δx2 is a thickness of the inner wall, k2 is a thermal conductivity of the inner wall, Δx3 is a thickness of the Fe sprayed layer, and k3 is a thermal conductivity of the Fe sprayed layer.

2. The cylinder block according to claim 1, wherein the thermal conductivity $k_1$ of the insulating coating layer is in the range of 0.8 to 5.0 W/mK.

3. The cylinder block according to claim 1, wherein the insulating coating layer comprises one selected from the group consisting of 3% by weight of Yttria-Stabilized Zirconia (YSZ), 7% by weight of YSZ, and 7% by weight of $Gd_2Zr_2O_7$.

4. The cylinder block according to claim 1, wherein the insulating coating layer is disposed at a portion of the inner wall corresponding to a moving path of the piston in the inner space.

* * * * *